US010982923B2

(12) United States Patent
Seghi et al.

(10) Patent No.: US 10,982,923 B2
(45) Date of Patent: Apr. 20, 2021

(54) QUICK ACTING MODULAR RIFLE INTERFACE

(71) Applicant: The United States of America, as represented by the Secretary of the Navy, Crane, IN (US)

(72) Inventors: Steven Seghi, Bloomington, IN (US); Kevin Kellar, Bloomfield, IN (US)

(73) Assignee: The United States of America, as Represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 16/811,175

(22) Filed: Mar. 6, 2020

(65) Prior Publication Data

US 2021/0041201 A1 Feb. 11, 2021

Related U.S. Application Data

(60) Provisional application No. 62/814,885, filed on Mar. 7, 2019.

(51) Int. Cl.
*F41A 21/48* (2006.01)

(52) U.S. Cl.
CPC ..... *F41A 21/482* (2013.01)

(58) Field of Classification Search
CPC ..... F41A 21/482
USPC ..... 42/76.01
See application file for complete search history.

(56) References Cited

U.S. PATENT DOCUMENTS

| | | | | |
|---|---|---|---|---|
| 6,591,534 | B1 * | 7/2003 | Trudeau | F41A 21/482 42/75.02 |
| 10,012,457 | B2 * | 7/2018 | Jones | F41C 23/00 |
| 2006/0053673 | A1 * | 3/2006 | Murello | F41C 27/06 42/71.01 |

* cited by examiner

*Primary Examiner* — Samir Abdosh
(74) *Attorney, Agent, or Firm* — Naval Surface Warfare Center, Crane Division

(57) ABSTRACT

The invention relates to quick acting interfaces that allow for easier transportation and maintenance of precision rifles. Embodiments include an interface with an engaging segment and a receiving segment that engage one another and lock together. The engaging segment may have a series of connective bearings that fit into indentations inside the receiving segment. Embodiments allow a firearm to be modulated such that a barrel of the firearm may be disassembled without the need of any specialized equipment and reassembled without impacting the firearm's accuracy or reliability. Embodiments are scalable such that multiple interfaces can be used to adjust the total length of the firearm barrel.

1 Claim, 11 Drawing Sheets

SECTION D-D

DETAIL E
SCALE 1:1

SECTION B-B

SECTION A-A

DETAIL B
SCALE 1:1

SECTION
A-A

QUICK ACTING MODULAR RIFLE INTERFACE

CROSS-REFERENCE TO RELATED APPLICATIONS

The present application claims priority to U.S. Provisional Patent Application Ser. No. 62/814,885, filed Mar. 7, 2019, entitled "QUICK ACTING MODULAR RIFLE INTERFACE," the disclosure of which is expressly incorporated by reference herein.

STATEMENT REGARDING FEDERALLY SPONSORED RESEARCH OR DEVELOPMENT

The invention described herein was made in the performance of official duties by employees of the Department of the Navy and may be manufactured, used and licensed by or for the United States Government for any governmental purpose without payment of any royalties thereon. This invention (Navy Case 200,580) is assigned to the United States Government and is available for licensing for commercial purposes. Licensing and technical inquiries may be directed to the Technology Transfer Office, Naval Surface Warfare Center Crane, email: Cran_CTO@navy.mil.

FIELD OF THE INVENTION

The field of the invention relates generally to firearms and components associated with them. In particular, exemplary embodiments are provided that include quick acting interfaces that allow for easier transportation and maintenance of precision rifles.

BACKGROUND AND SUMMARY OF THE INVENTION

Current technology does not allow for quick transportation and maintenance of precision rifles. In particular, sniper rifles lack the capacity to be disassembled without conventional tools, that are not readily available in mobile situations. There is a need for a compact, take-down style precision rifle that will allow modularity for situation specific barrel lengths and types. Currently, there is no feasible way to readily transport and conceal a precision rifle. One obstacle in the way of easily transportable precision rifles is the length and construct of the barrel of the rifle. Many precision rifles tend to have barrel lengths greater than 24 inches. In addition, most current rifles do not allow a sniper rifle to be disassembled without the use of special tools. Furthermore, current rifles must be sent back to the shop for barrel replacement and realignment after a specified amount of use.

There is also a need to improve sniper rifles designs so that they do not need to be sent back to the depot for dismantling and repair after a certain number of shots are taken through the barrel. Most operators have a specific precision firearm they prefer and when these tools must be replaced or repaired there is a loss of time. By having a modular design for the rifles, it would be possible for field replacement of the entire barrel as well as the breakdown and stowage of the components into small packages. Thus, the operator can continue to utilize the basic components with which he is familiar and comfortable. Exemplary embodiments of the quick-acting modular rifle interface allows precision rifles to be broken into smaller modular components for storage and transportation.

BRIEF DESCRIPTION OF THE DRAWINGS

The detailed description of the drawings particularly refers to the accompanying figures in which.

DETAILED DESCRIPTION OF EMBODIMENTS OF THE INVENTION

Embodiments of the disclosure described herein are not intended to be exhaustive or to limit the disclosure to precise forms disclosed. Rather, the embodiments selected for description have been chosen to enable one skilled in the art to practice the disclosure.

Generally, an embodiment of the present invention allows for a firearm to be modulated such that a barrel of the firearm may be disassembled without the need of any specialized equipment, such that the firearm may be transported in a more compact manner. The modulation of the barrel will have negligible effects on the operation of the firearm (i.e., loss of accuracy, firearm malfunction, added weight).

Figure 1:
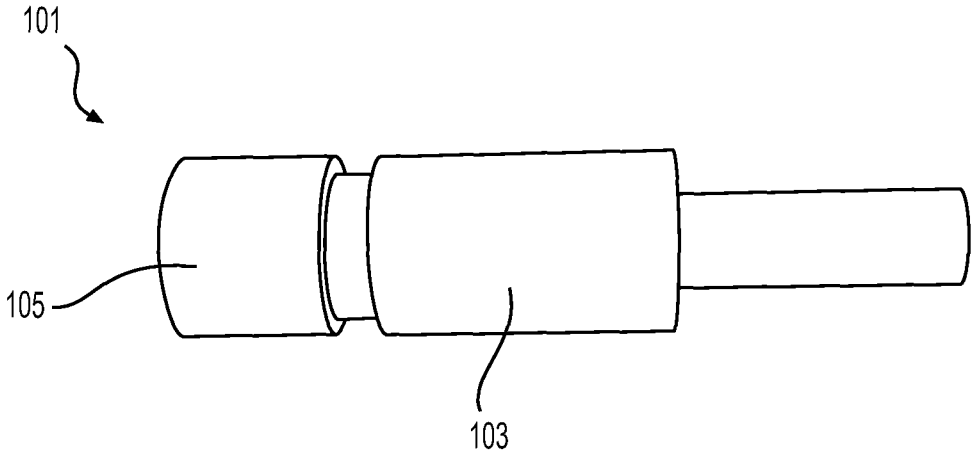
FIG. 1 shows an exemplary embodiment of a quick-acting modular rifle interface with the interface locked together by two pieces.

Referring to FIG. 1, a quick-acting modular rifle interface 101 may be seen. The quick-acting modular rifle interface 101 may include a plurality of segments that can be interlocked together. In some embodiments, there may be two segments, while other embodiments may include more segments, for example, three or more segments may be used. FIG. 1 shows a receiving segment 103 and an engaging segment 105 coupled together via a connection mechanism. Receiving segment 103 and engaging segment 105 may be made of any suitable material used in constructing rifle barrels such as stainless steel, steel alloys, carbon steel, chrome molybdenum, or any other material known in the art.

There are multiple places on the rifle that one or more quick-acting modular rifle interfaces 101 could be positioned, some embodiments include where the barrel connects with the rifle receiver and/or one or more places along the barrel. In an exemplary embodiment, the quick-acting modular rifle interfaces 101 may comprise engaging segment 105 that can be permanently affixed to the rifle receiver at a pre-set location.

Figure 2:
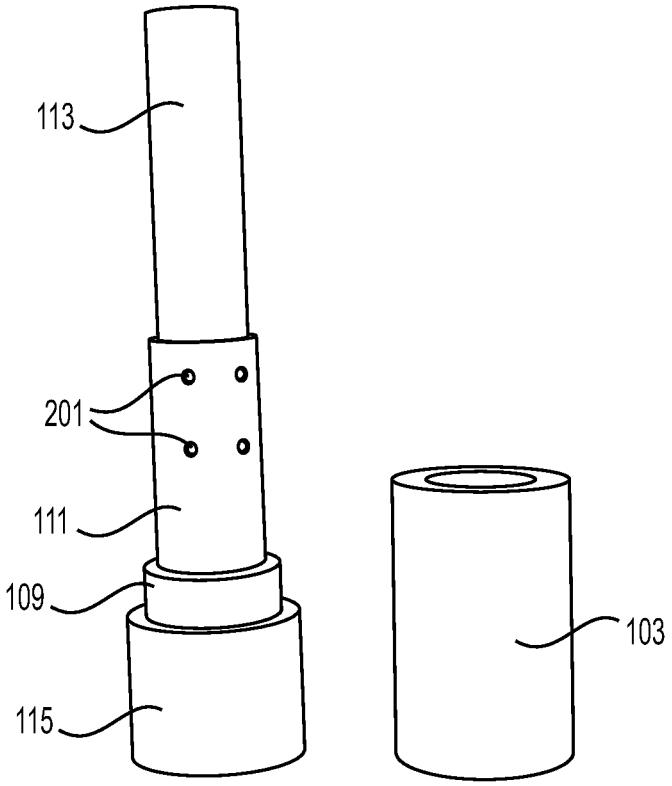
FIG. 2 shows the exemplary embodiment of FIG. 1, wherein the two pieces of the quick-acting modular rifle interface are disengaged and separated.

FIG. 2 shows an exemplary embodiment of the quick-acting modular rifle interface 101 when the device is uncoupled. In at least one embodiment, engaging segment 105 may contain a plurality of connective bearings 201 as the connection mechanism. In other embodiments the connection mechanism may comprise any suitable removable fastener known in the art, including, but not limited to, threaded fasteners, magnets, bolts, pins, pneumatic couplers or the like. In some embodiments, the quick-acting modular rifle interface 101 may include a matching, serialized bolt that has already been head spaced to the barrel. This may allow for the rifle's barrels to be replaced without the necessity of sending it to a specialty shop for replacement and head spacing with special tools, making field replacement of barrels possible.

The quick-acting modular rifle interface 101 may have an engaging segment 105 and a receiving segment 103 that engage one another and lock together. The engaging segment 105 may have a series of connective bearings 201 that fit into indentations (not shown) inside the receiving segment 103. In some embodiments this may have the effect of acting as locking lugs.

Figure 3:
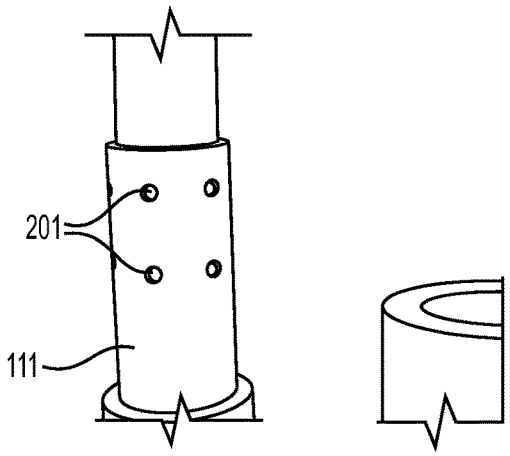
FIG. 3 shows a close up of the exemplary embodiment of FIG. 1, a male portion of the quick-acting modular rifle interface shows a ball bearing connection system in an in position.

In some embodiments, the receiving segment 103 may be include a receiving thread (not shown) threaded in a direction opposite of the thread in the engaging segment 105. The opposing thread may disengage the two segments by retracting the connective bearings 201 into the engaging segment 105 as shown in FIG. 3, allowing the two segments to be separated.

In some embodiments, the engaging segment 103 may include at least two or more cylindrical shaped portions. The portions may comprise separate, distinct outer radii. In one example, as shown in FIG. 2, the engaging segment may comprise four portions (a barrel portion 113, a bearing portion 111, a threaded portion 109, and a connector portion 115).

The retracted connective bearings 201 may be positioned such that the outer surface of the connective bearings 201 may be closer to the center of the cylindrically shaped engaging segment 103 than the outer radius of the bearing portion 111. The retracted connective bearings may make it possible to easily separate the engaging segment 105 from the receiving segment 103. Thus, allowing the barrel to be deconstructed for stowage and transportation.

Figure 4:
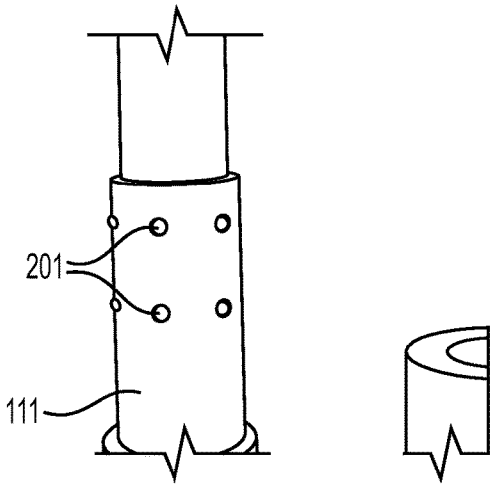
FIG. 4 shows a close up of the exemplary embodiment of FIG. 1, a male portion of the quick-acting modular rifle interface shows a ball bearing connection system in an out position.

Referring to FIG. 4, the connective bearings may be positioned to a protruding position. The protruding connective bearings 201 may be disposed such that the extend further from the center of the engaging segment 103 than the outer radius of the bearing portion 111. The receiving segment 103 may be threaded onto the engaging segment 105 where, once in place, the connective bearings 201 may lock into the indentations found in receiving segment 103. Once the connective bearings 201 are engaged, the quick-acting modular rifle interface 101 may sufficiently withstand the shock and other force generating actions associated with firing a precision rifle.

Figure 5:
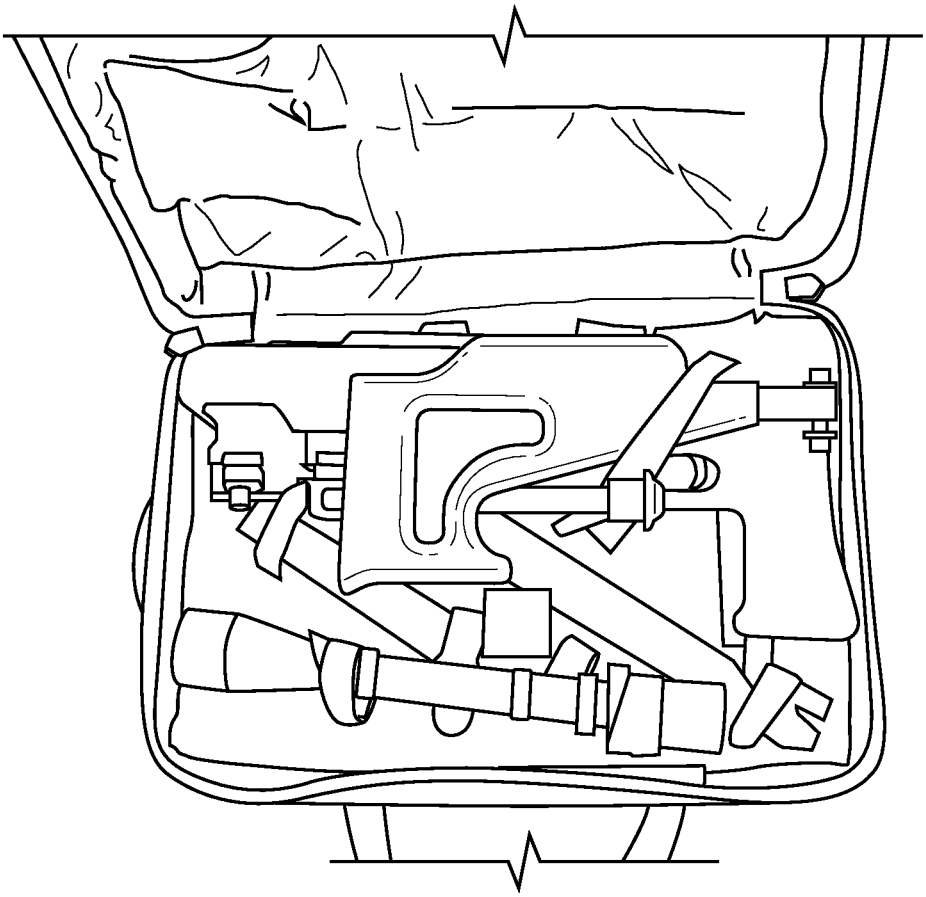
FIG. 5 shows an embodiment of a quick-acting modular rifle interface in use with a precision rifle, where said rifle is stowed for easy transportation.

FIG. 5 shows an exemplary version of a rifle that has been fully disassembled and stowed away in a carry case for easy transportation. In some embodiments, the disassembled rifle may be configured to fit in a case smaller than 20×20 in. Other embodiments, allow storage of the disassembled rifle in a case larger than 20×20 in.

Figure 6:
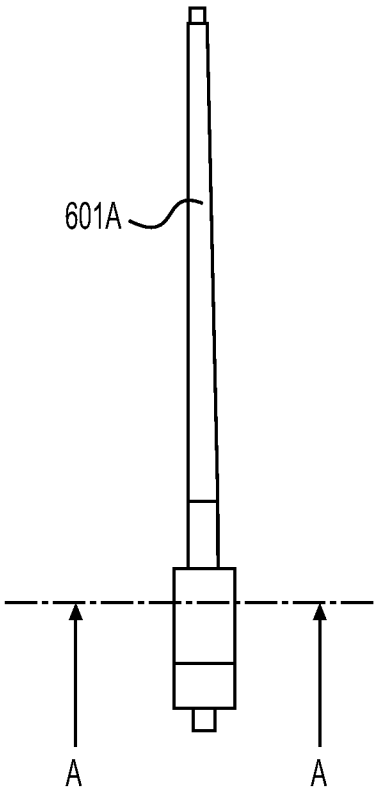
FIG. 6 shows a receiving segment with a barrel extension.
Figure 8:
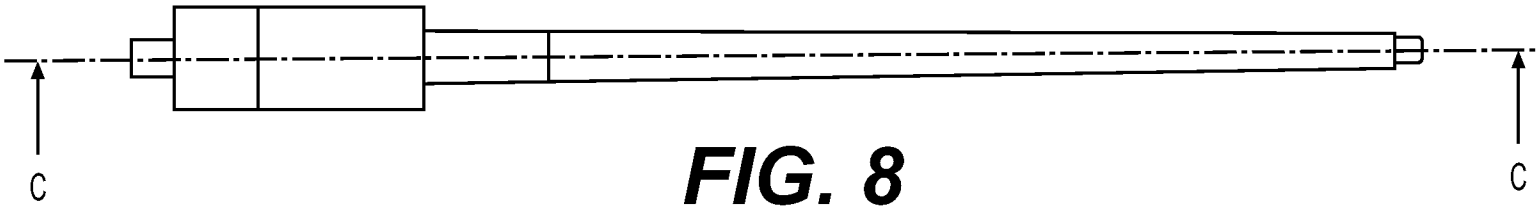
FIGS. 8-15 show exemplary views of a quick-acting modular rifle interface coupled to a rifle barrel.
Figure 9:
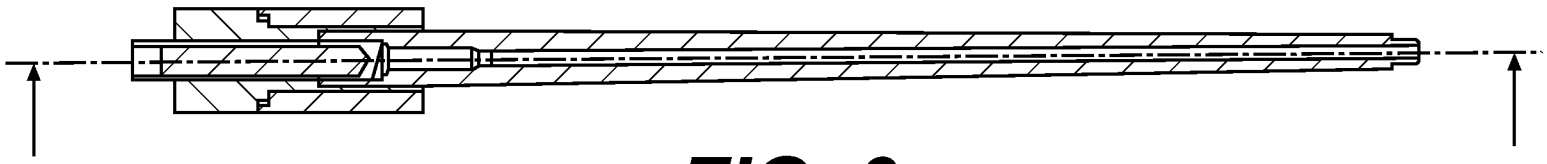
Figure 10:
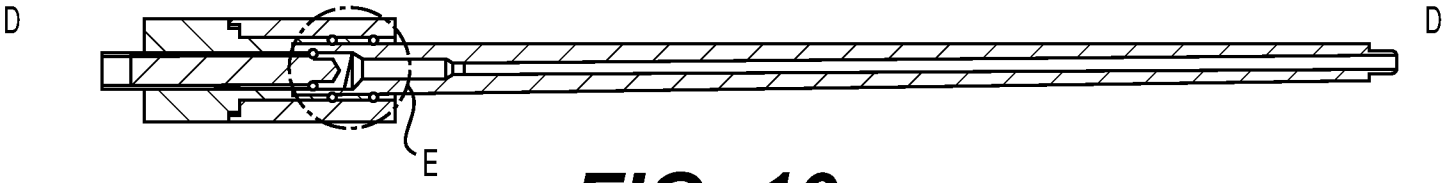
Figure 11:
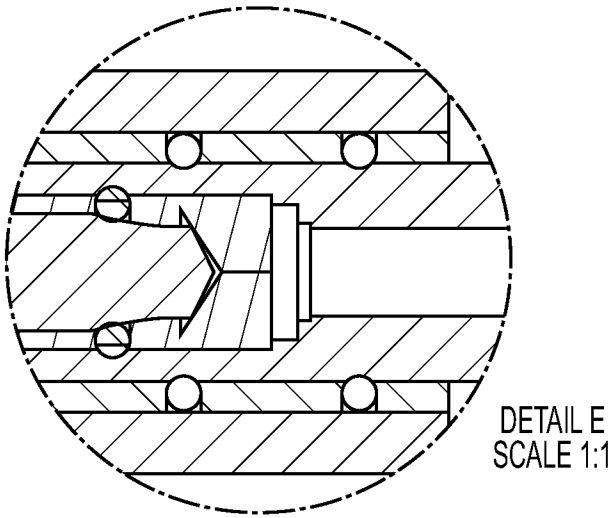
Figure 12:
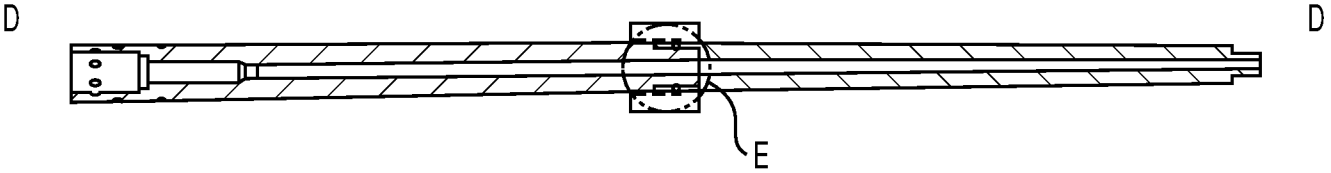
Figure 13:
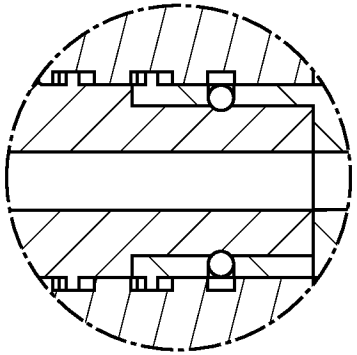
Figure 14:
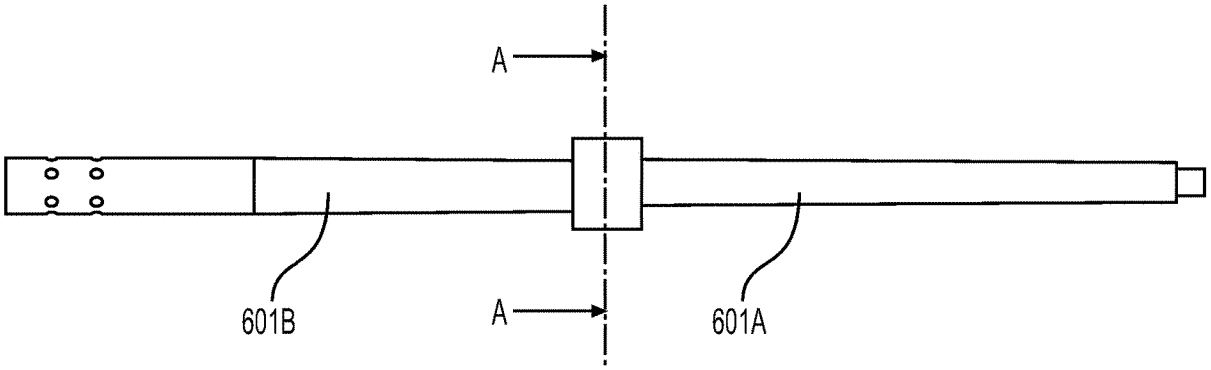
Figure 15:
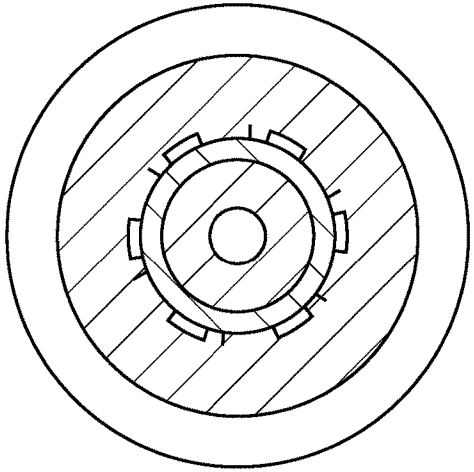
Figure 16:
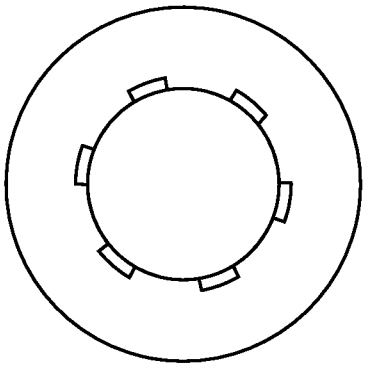
FIGS. 16-19 show cross-sectional views of a quick-acting modular rifle interface.
Figure 17:
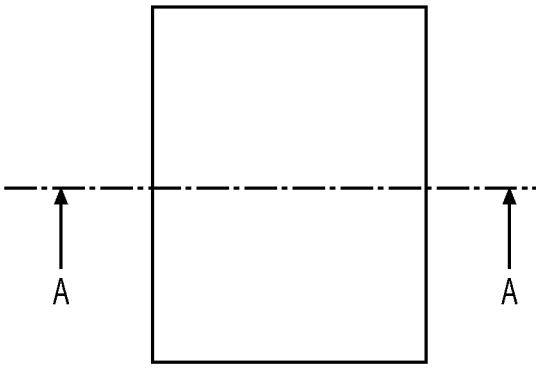
Figure 18:
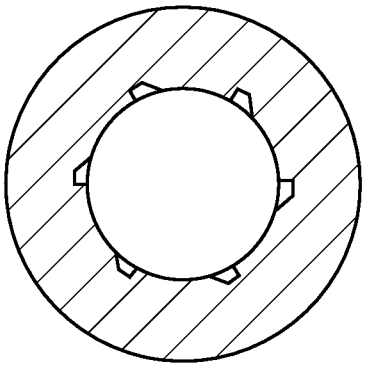
Figure 19:
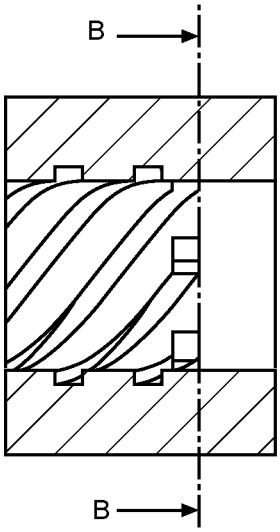
Figure 22:
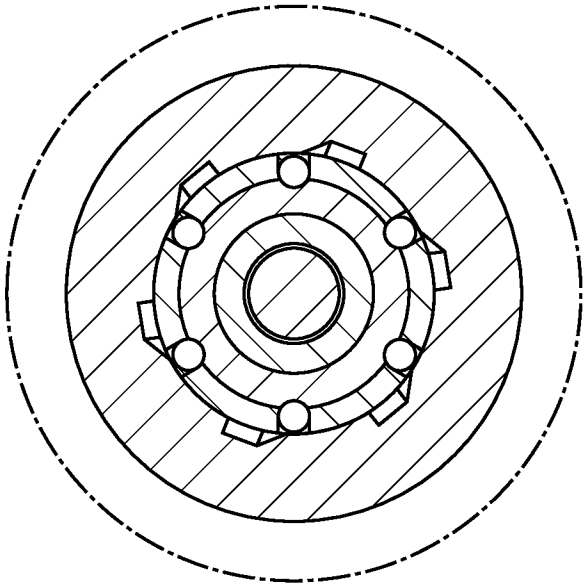
FIGS. 20-22 show additional views of a quick-acting modular rifle interface.
Figure 21:
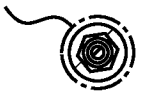
Figure 20:
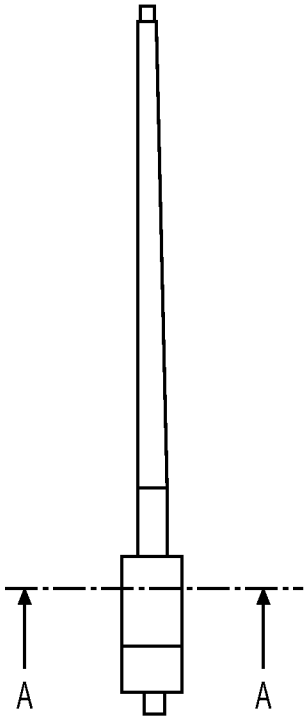

While FIG. 1 may only show a connection area of the receiving segment 103 and engaging segment 105, other embodiments may contain a hollow cylindrical extension protruding from the quick-acting modular rifle interfaces 101 defining a barrel extension 601. In some embodiments, the engaging segment 105 and/or the receiving segment 103 may contain a barrel extension 601 as seen in FIG. 6. A barrel extension 601A may be affixed to the receiving segment 103 and a barrel extension 601B (not shown) may be affixed to the engaging segment 105 may be substantially the same size. Barrel extension 601A and 601B may be configured to align when the receiving segment 103 is coupled to the engaging segment 105, such that barrel extension 601A when acting in connection with the barrel extension 601B form the entire barrel of the precision rifle. In some embodiments barrel extension 601A may comprise up to 95% of the total length of the rifle barrel, while in other embodiments, the barrel extension 601A may comprise only 5% of the total length of rifle barrel, or percentage in between. While some quick-acting modular rifle interfaces 101 may comprise barrel to a barrel interface, others may comprise a barrel to receiver interface.

Figure 7:
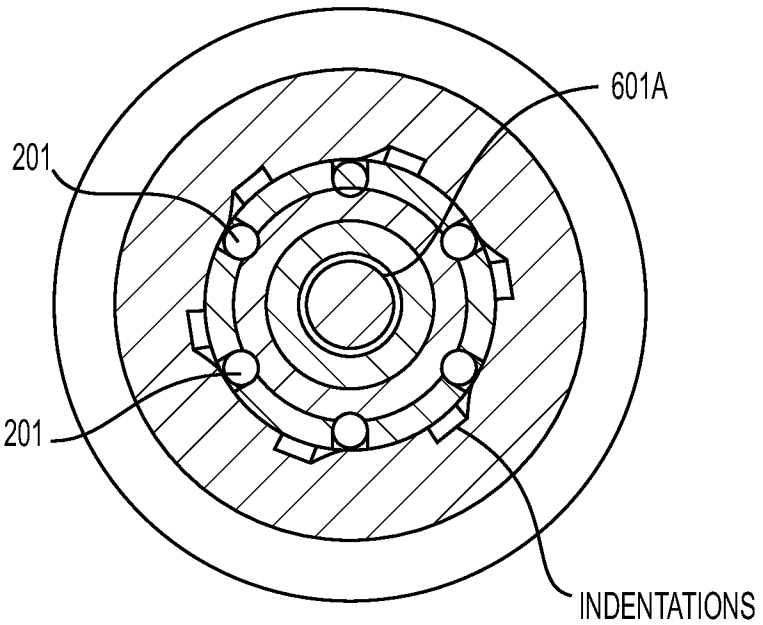
FIG. 7 shows a latitudinal cross-sectional view of one embodiment of a cylindrical quick-acting modular rifle interface.

FIG. 7 shows a latitudinal cross-sectional view of one embodiment of a cylindrical quick-acting modular rifle interface 101. The barrel extension 601A may be defined as the hollow circular region with the smallest diameter. In the embodiments where the receiving section 103 and engaging section 105 may be locked together via connective bearings 201. In some embodiments, the receiving segment 103 may be joined to the engaging segment 105 through the use of threaded sections located on each segment. The receiving segment 103 and engaging segment may be rotated to further engage the threads. As the threads become more interconnected by rotating the receiving segment 103 and engaging segment 105, the connective bearings 201 on the engaging segment 105 may protrude from the bearing portion 111 and insert into indentations found in receiving segment 103. The introduction of the connective bearings 201 into the indentations may lock the receiving segment 103 and engaging segment 105 together such that the locking of the segments is able to withstand significant forces associated with the use and handling of a rifle.

Although the invention has been described in detail with reference to certain preferred embodiments, variations and modifications exist within the spirit and scope of the invention as described and defined in the following claims.

The invention claimed is:

1. A quick-acting modular rifle interface comprising:

an engaging mechanism comprising a first end and a second end, wherein the second end opposes the first, and wherein the engaging mechanism comprises at least one hollow cylindrical section of equal inside radii and different outside radii center aligned from the first end to the second end;

wherein the at least one hollow cylindrical section comprises a bearing section, a threaded section, and an outer section, wherein:

the bearing section comprises a right circular hollow cylinder wherein a plurality of connective bearings are disposed along an outer surface of the bearing section, wherein the plurality of connective bearings are configured to extend and retract past the outer surface of the bearing section;

the threaded section comprises a right circular hollow cylinder wherein the outer surface of the threaded section is threaded;

the outside section comprises a right circular hollow cylinder configured to have an outside radius larger than the threaded section;

a receiving mechanism comprising a first end and a second end, wherein the second end opposes the first, and wherein the receiving mechanism is a right circular hollow cylinder, wherein a section of the inside radius of the receiving mechanism is threaded, such that the thread is configured to receive the threaded section of the engaging mechanism so that the first end of the receiving mechanism is flush with the outside section of the engaging mechanism;

wherein the second end of the engaging mechanism is disposed inside the receiving mechanism;

wherein the receiving mechanism comprises a plurality of indentations configured to receive the connective bearings of the engaging mechanism when the receiving mechanism and engaging mechanism are coupled together;

a receiving barrel affixed to the second end of the receiving mechanism, wherein the receiving barrel is a hollow cylindrical shell extending from the receiving mechanism wherein an inside radius of the receiving barrel is aligned with and equivalent to the inside radius of the receiving and engaging mechanism;

wherein the receiving barrel is flush with the second end on the engaging mechanism; and an engaging barrel affixed to the first end of the receiving mechanism, wherein the engaging barrel is a hollow cylindrical shell extending from the engaging mechanism wherein an inside radius of the engaging barrel is aligned with and equivalent to the inside radius of the receiving and engaging mechanism; and wherein the engaging barrel is coupled to a rifle and configured such that a bullet may travel from the engaging barrel to the receiving barrel.

* * * * *